United States Patent [19]

Clark et al.

[11] 3,977,220

[45] Aug. 31, 1976

[54] WASHING OF ELONGATE MATERIALS

[75] Inventors: Peter John Clark, Stoney Stratford; Richard Sidney Shanahan, Birmingham, both of England

[73] Assignee: Strattwell Developments Limited, London, England

[22] Filed: Jan. 21, 1975

[21] Appl. No.: 542,869

[30] Foreign Application Priority Data

Jan. 28, 1974 United Kingdom ..... 3798/74

[52] U.S. Cl. ..... 68/22 R; 68/27; 68/62; 226/119

[51] Int. Cl.[2] ..... D06B 1/02; D06B 3/12

[58] Field of Search ..... 68/9, 22 R, 27, 62, 68/176, 177, 178, 179, 181 R, 205 R; 226/119

[56] References Cited

UNITED STATES PATENTS

| | | | |
|---|---|---|---|
| 493,627 | 3/1893 | Kohlrausch | 68/176 X |
| 1,363,223 | 12/1920 | Biach | 68/176 X |
| 1,665,977 | 4/1928 | Planell | 68/22 R |
| 3,145,554 | 8/1964 | Grimes | 68/22 R |
| 3,162,033 | 12/1964 | Grimes | 68/22 R |
| 3,875,769 | 4/1975 | Inoue | 68/176 X |

*Primary Examiner*—Philip R. Coe
*Attorney, Agent, or Firm*—Cushman, Darby & Cushman

[57] ABSTRACT

An apparatus for washing elongate material including means for passing the material sequentially through a plurality of washing and soaking sections by means of a plurality of driving and driven rollers arranged to squeeze the material, as well as to control the feeding of the material through the apparatus.

3 Claims, 3 Drawing Figures

WASHING OF ELONGATE MATERIALS

This invention relates to washing and in particular to a washing apparatus for elongate, preferably textile, material e.g. towel roll lengths sewn (or otherwise joined) end to end.

According to one aspect of this invention there is provided washing apparatus for elongate material comprising a plurality of roll means for causing said elongate material to pass lengthwise through said apparatus in a plurality of sequential passes, said roll means being positioned adjacent one another in a line transverse to the direction of said passes.

Preferably the roll means lie in a line perpendicular to said direction, and share common support frames. Each roll means may comprise at least one driving-roll and one driven roll, and the driving rolls may share a common power source.

The driven roll (s) of a pass may be mounted, e.g. on a frame, for movement away from the driving roll (s). Preferably a sensor responsive to the input to at least the second and/or any subsequent pass, is arranged to induce, e.g. by an appropriate signal to operate frame-moving means, said movement away of the driven roll (s) of the preceding pass.

By way of example, washing apparatus, constituting one embodiment of this invention, and its operation, will now be described with reference to the accompanying drawings, of which:-

Figure 1:
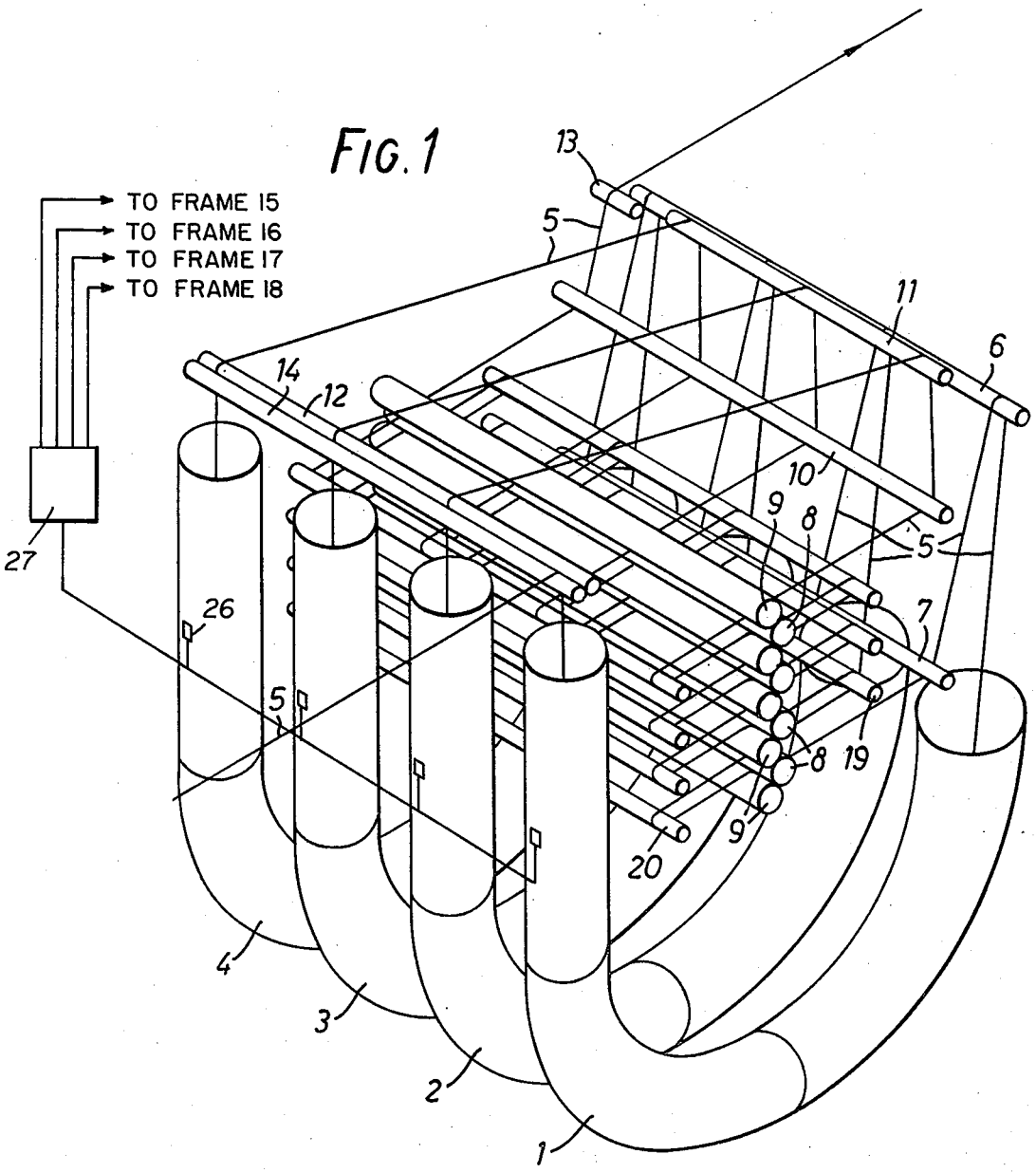
FIG. 1 is a schematic isometric representation of said apparatus, illustrating certain parts thereof.
Figure 3:
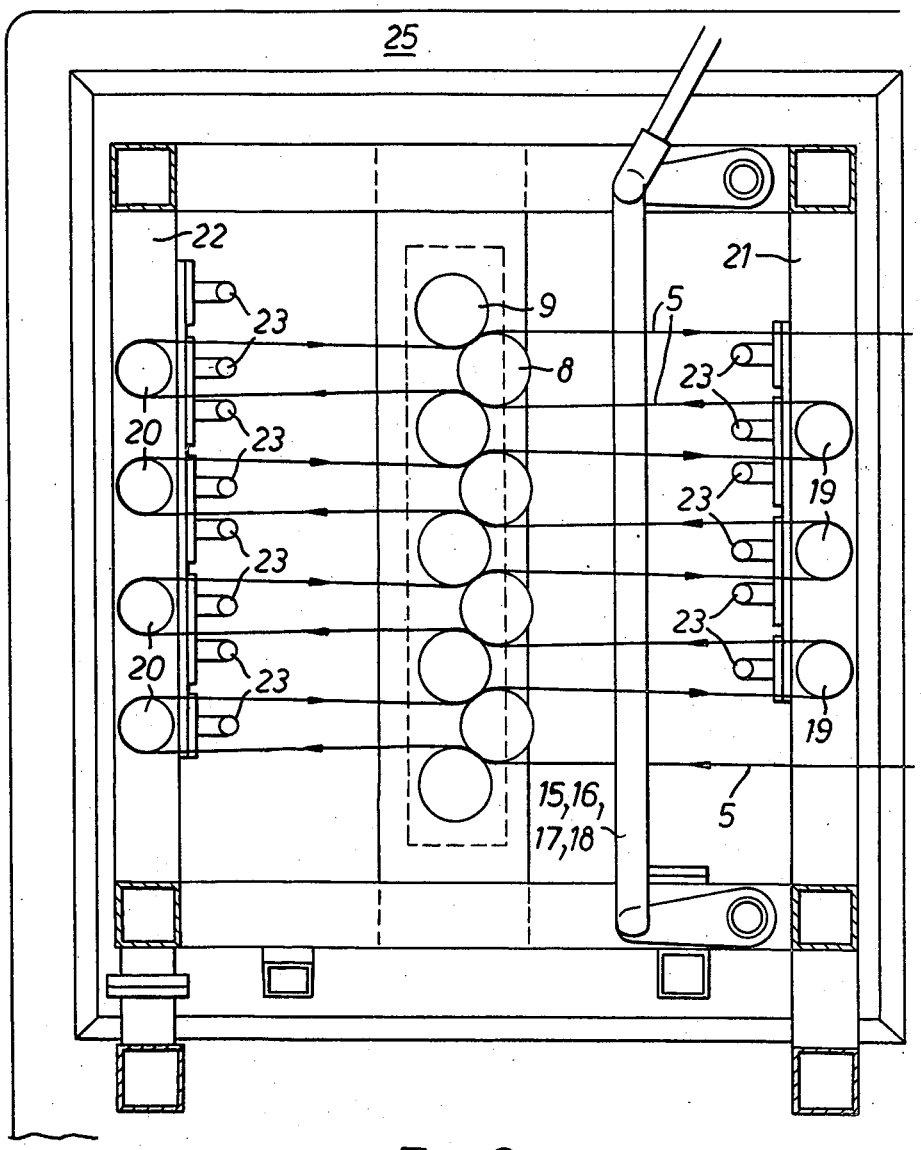
FIG. 3 is a side view sketch of said apparatus, illustrating still other parts thereof not shown in FIGS. 1 and 2 (but omitting others that are so shown).

In this embodiment, a washing cabinet 25, FIG. 3 comprises a treatment chamber (not shown) disposed between the opposite upright portions of four parallel J-shaped (or U-shaped) tubes 1 to 4, FIG. 1. The tubes 1 to 4 provide storage for elongate material and soaking thereof with treatment liquor preparatory to each of four passes thereof through the treatment chamber along a path indicated by the reference numeral 5. The elongate material to be laundered is a continuous band of cloth towel roll lengths sewn or otherwise joined end to end for the continuous laundering process and afterwards rolled up and separated again at the (sewn) joints into individual rolls. Each of the J-tubes 1 to 4 shown increases progressively in cross sectional area towards its outlet so as to minimise the frictional drag on forward movement of the elongate material through the tubes. Each of the tubes 1 to 4 may be U-shaped and/or have a uniform cross sectional area. The J-tubes 1 to 4 need not be of circular cross-section.

The continuous towel band (hereinafter signified by the reference 5) enters the first storage tube 1 (to commence the first pass). The band 5 leaves the first storage tube 1, is threaded over a tube-exit idler roller 6, under a chamber-entry idler roller 7, sinuously through the several nips between cooperating driven and driving pressure squeeze rolls 8, 9 respectively, and round a chamber-exit idler roller 10 to leave the chamber from the same side as that at which it entered. The band 5 then threads its way over a path-change idler roller 11, crosses the chamber at an angle and threads over a tube-inlet idler roller 12 towards the upright inlet portion of the second storage tube 2 to conclude its first pass through the treatment chamber.

The idler rollers 6, 7, 10, 11, and 12, and the set of five driving rolls 9, are common to all or several of the passes; and the path taken by the band 5 during each of the second, third and fourth passes is identical in form of the first pass just described, except that for the fourth pass, the band 5 threads over a cabinet-exit idler roller 13 instead of rollers 11 and 12.

Another tube-inlet roller 14 (illustrated as common to all the passes) may form a nip for the towel band 5 with the tube-inlet roller 12, the band portion fed to the first pass i.e. into the cabinet, also passing through this nip and being driven thereby.

Figure 2:
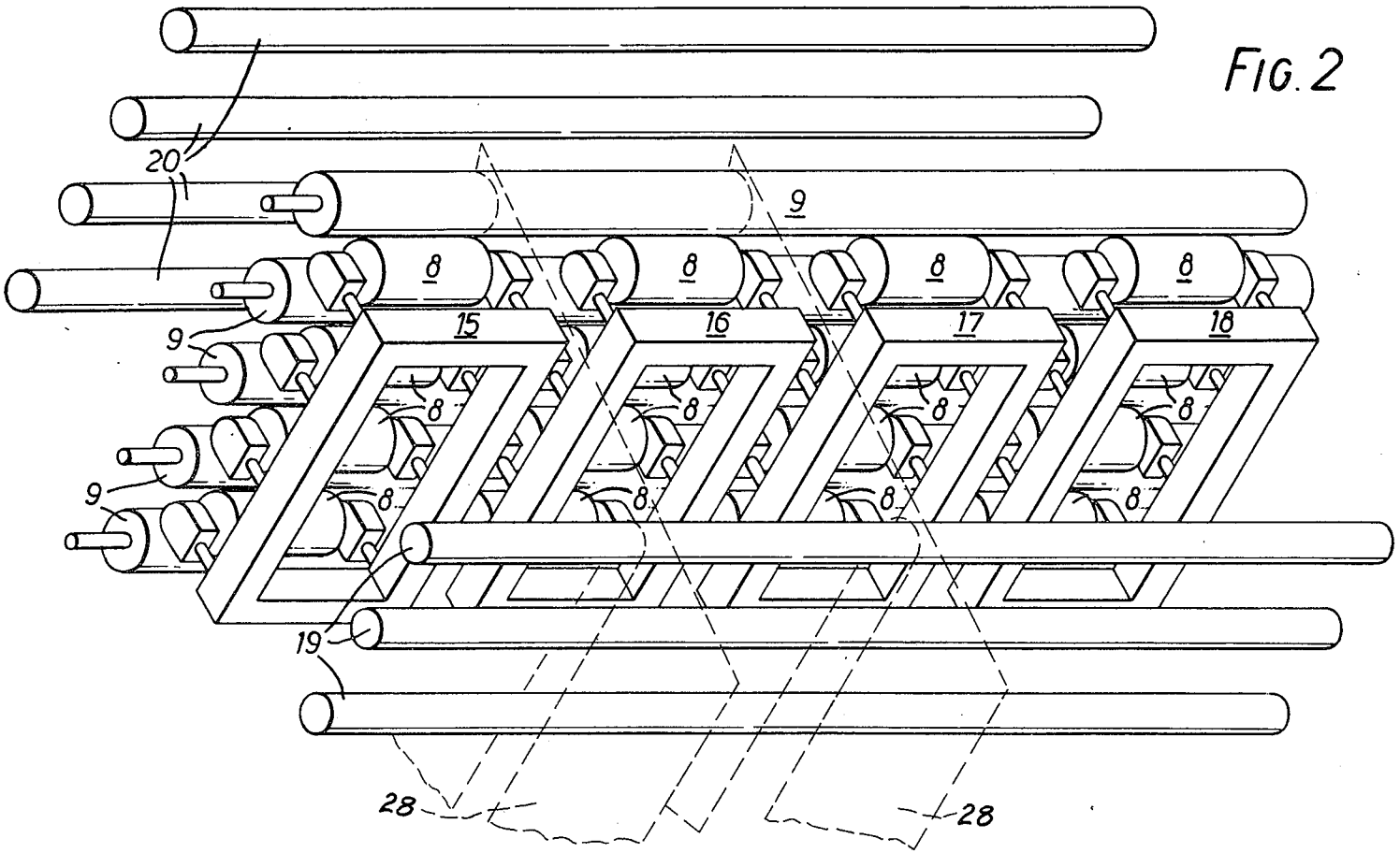
FIG. 2 is a similar representation of said apparatus, illustrating certain other parts thereof not shown in FIG. 1.

For each pass, a set of four rolls 8 is provided on an individual frame with each roll 8 individually mounted adjustable or spring loaded or otherwise resiliently urged away from the frame. The four frames, one for each of the four passes, are indicated by the reference numerals 15 to 18 in FIG. 2. Each of the frames 15 to 18 is urged (preferably resiliently) towards the fixed driving rolls 9. In use each roll 9 is driven via a multi-spindle gearbox from an electric motor outside the chamber. Co-operation of rolls 8 and 9 forms eight nips in each pass. The band 5 extends in each pass sinuously through these eight nips and is turned back upon itself seven times by means of directional-reversing idler rollers 19 and 20. In extending through said eight nips the pressure on band 5 can be adjusted by regulating the force applied by the frame and/or by regulating the force applied by each roll 8 mounted resiliently and/or adjustably on the frame. The rollers 19 and 20 are common to all the passes and are disposed at the sides of the treatment chamber. The rollers 19 and 20 are mounted respectively on frames 21 and 22 that additionally support spray tubes 23 for spraying treatment liquor downwardly and/or upwardly upon the sections of the band 5 that pass respectively beneath and/or above the spray tubes 23 of that pass. A separate spray pipe assembly control tank and pump is provided for each pass to enable a pre-wash treatment liquor to be sprayed in the first pass, two similar or different main wash treatment liquors to be sprayed in the second and third passes, and a rinsing treatment liquor to be sprayed in the fourth pass. The treatment tank is provided with divisions two of which are shown at 28 in dotted lines in FIG. 2, to contain the sprays associated with one pass to that pass.

In normal operation, the band 5, in traversing the first three passes of the above described and illustrated cabinet, undergoes a washing treatment in each pass. This treatment comprises the spraying of washing liquor on to the moving band 5 at several locations and squeezing this liquor through the band material by the successive feeding rolls 8, 9 of that pass. In the fourth pass, the band 5 is sprayed with a rinsing liquor (in the same way as a washing liquor was sprayed in each of the preceding passes) and squeezed by the successive feeding rolls 8, 9 of the fourth pass to leave the cabinet via the idler rollers 10 and 13.

Preferably the sprays of the first, second and third washing passes are connected in a liquor supply and distribution system arranged to ensure that washing liquor is utilized in contra-direction to movement of band 5 through these passes. Particularly each pass has a tank associated therewith and liquor to the sprays of the third pass is pumped from the third tank associated with that pass and to some extent supplied with fresh liquor, liquor to the sprays of the second pass is pumped from the second tank associated with that pass and to some extent supplied with liquor from the third tank, and liquor to the sprays of the first pass is pumped from the first tank associated with that tank and to some extent supplied with liquor from the second tank. The liquor level in each tank may be controlled (e.g. by a ball-cock valve connected in its supply line) to ensure that the tank liquor remains at substantially constant level in that tank. The liquor pumped from each tank to the spray heads of that pass is also pumped to the entrance of the longer limb of the J-tube associated with that pass. Thus the band 5, whilst being stored in each J-tube, is soaked with treatment liquor appropriate to that pass.

Each of the frames 15 to 18 is retractable by an actuator 27 to move its set of rolls 8 away from the rolls 9. Each of the four actuators may be pneumatically or hydraulically operable (e.g. by a piston-cylinder arrangement) or be electrically operable (e.g. by the solenoid of an electromagnetic device) or be mechanically operable (e.g. by a cam).

In the inlet portion of each of the J-tubes 2, 3 and 4 (i.e. in the left-hand upright portion thereof below rollers 12, 14) there is provided a sensor as at 26 that is triggered if the level of towel cloth in that tube rises to a predetermined level (e.g. because of towel stretching or its slippage through roller nips). The sensor may be triggered by the interruption of a radiation or sonic beam or, as preferred, of a water jet. The sensor, when thus triggered is arranged to produce an appropriate signal that causes the actuator 27 of the immediately preceding pass to retract the frame (i.e. 15, 16 or 17) of said immediately preceding pass. The driven rolls 8 of that pass are thus disengaged from the driving rolls 9 so that both the output feed and the input feed of that pass are stopped although passage of the band 5 through the remaining passes can continue. The frame may be held in its retracted position by the sensor signal until the sensor is reset. Alternatively it may be held off for a predetermined timer-controlled period (e.g. 2 minutes), after which the sensor state is monitored to ascertain whether it is yet in its non-triggered state i.e. whether the level of towel cloth in that J-tube has fallen sufficiently.

If a halt-situation occurs such that the sensor associated with tube 4 is triggered (i.e. when tube 4 is too full) frame 17 of the third pass is retracted to interrupt the third pass but allow the first, second and fourth passes to continue with the band 5 sections that are stored in tubes 1, 2 and 4. If the halt-situation does not clear, the level of towel cloth in the inlet portion of tube 3 increases until the sensor associated with that tube is triggered to cause retraction of frame 16 and interruption of the band's second pass, through allowing the first and fourth band passes to continue. If the halt-situation is such that the first frame 15 is retracted, the continuous drive supplied to the common driving rolls 9 continues but the feed of band 5 from the input drive is halted. The continuous machine drive to the common driving rolls 9 need only be switched off if all four frames 15 to 18 are retracted so that there is neither input nor output of the band 5 to or from the laundering cabinet. The fourth frame 18 may be retracted in response to a sensor-derived signal arising from adverse conditions in a post-wash mangle and/or drying apparatus.

Although the rollers 6, 7, 10, 11, 12, 14, 19 and 20 of the above described embodiments are illustrated and referred to as being common to all or several passes, they may be split so as to be each arranged individually (e.g. in the form of pulley wheels) with respect to one pass. This may be desirable (particularly if the common idlers are spring-loaded tensioning jockeys) if the passage of the band around the common rollers in one pass causes rotation of the common rollers such as to move the band in another pass in which the driven rolls 8 have been retracted i.e. there is insufficient skidding of the band material with respect to the rollers.

It will be appreciated that the pressure rolls 8, 9 are used both for squeeze action upon the towel band 5 and for driving it through that pass. In this way variations in the lineal speed of the material through a pass can be controlled.

The apparatus described is suitable for the washing of elongate material in either flat or rope form, and can be applied to towelling strip as mentioned, or to other finished or semi-finished textile goods. 'Washing' means not just laundering, but is intended to include similar or associated processes such as rinsing, bleaching, starching, scouring or other chemical treatments. The apparatus is not restricted to four passes. Normally, each pass will take place in a separate chamber, although chambers will be grouped into single cabinets. In the four-pass apparatus illustrated, it may be convenient to have two cabinets each with two passes, with an access passage between the two cabinets.

What we claim is:

1. Washing apparatus for elongate material in which the material is caused to pass lengthwise through the apparatus in a plurality of sequential passes, each pass including a washing section and a soaking section, each washing section comprising means to spray the material and a plurality of driving and driven rollers disposed to provide a serpentine path for the material said plurality of rollers comprising at least three rollers defining squeezing means for said material in each said washing section, each soaking section comprising an axially curved tube providing for storage and soaking of the of the material therein and also- has been inserted providing a return path for the material from the end of any one washing section to the beginning of the next in sequence, at least one of said three rollers being a driven roller which is resiliently engaged at spaced apart points by said other two rollers, means for effecting relative disengagement between said driven roller and said other two rollers so as to interrupt drive of the material through said washing section, each said washing section being housed in a separate chamber, said chambers being positioned side-by-side and wherein adjacent chambers have a common driving roller positioned transverse to the direction of travel of said elongate material.

2. The washing apparatus as claimed in claim 1 wherein said tubes each lie vertically below said washing sections.

3. The washing apparatus as claimed in claim 1 wherein said other two rollers are provided with means for moving said other two rollers out of driving engagement with said driven roller and into driving engagement with said driven roller, means for controlling movement of said moving means including sensors located in a said soaking section.

* * * * *